United States Patent [19]

Weyer

[11] 4,409,888

[45] Oct. 18, 1983

[54] COMBINED LINEAR AND ROTARY ACTUATOR AND FLOATING RING GEAR

[76] Inventor: Paul P. Weyer, 48811 284th Southeast, Enumclaw, Wash. 98022

[21] Appl. No.: 146,335

[22] Filed: May 2, 1980

[51] Int. Cl.[3] ..... F01B 3/00

[52] U.S. Cl. ..... 92/31; 92/147

[58] Field of Search ..... 92/2, 31, 33, 51, 52, 92/53, 167, 136, 167; 74/89.15, 99 R

[56] References Cited

U.S. PATENT DOCUMENTS

| | | | |
|---|---|---|---|
| 3,151,533 | 10/1964 | Hartel | 92/136 |
| 3,329,069 | 7/1967 | Feroy | 92/33 |
| 3,339,463 | 9/1967 | Updegrave | 92/31 |
| 3,424,065 | 1/1969 | Kurt | 92/167 |
| 3,457,838 | 7/1969 | Rowe | 92/33 |
| 3,616,728 | 11/1971 | Kennedy | 92/51 |
| 3,763,747 | 10/1973 | Beichel | 92/33 |
| 3,842,715 | 10/1974 | Maier | 92/31 |
| 3,973,468 | 8/1976 | Russell, Jr. | 92/2 |
| 4,217,793 | 8/1980 | Abe | 74/89.15 |
| 4,290,344 | 9/1981 | Adams | 92/31 |

FOREIGN PATENT DOCUMENTS

| | | | |
|---|---|---|---|
| 1030563 | 5/1966 | United Kingdom | 92/33 |
| 272753 | 6/1970 | U.S.S.R. | 92/33 |
| 566030 | 10/1977 | U.S.S.R. | 92/136 |

*Primary Examiner*—Abraham Hershkovitz
*Attorney, Agent, or Firm*—Seed, Berry, Vernon & Baynham

[57] ABSTRACT

A ring gear of a helically splined rotary actuator is separately and independently joined to the outer cylindrical body of the actuator and meshes with the splined piston sleeve of the rotary actuator. The outer cylindrical body is a smooth, continuous body. In one form of the invention, the ring gear is secured to the outer cylindrical body with flush mountings so that the entire body can be slid past end seals of a hollow boom or further outermost cylindrical tube. In a preferred embodiment, the ring gear is loosely joined to the outer cylindrical body so that it can conform to irregularities or tolerance errors in the splines of the piston sleeve and can accommodate bending in the outer cylindrical body or the rotary output shaft due to heavy bending loads on the actuator. Another feature of the invention is a combined linear and helically splined rotary actuator which can provide both rotary and linear movement relative to an output shaft and an outer boom tube; and in the preferred embodiment of this feature of the invention, the ring gear for the helically splined rotary actuator is a separate, independently mounted ring gear with a flush mounting on the other surface of the outer cylindrical rotary actuator body so that the body can pass through the end seals of the outer boom tube.

7 Claims, 6 Drawing Figures

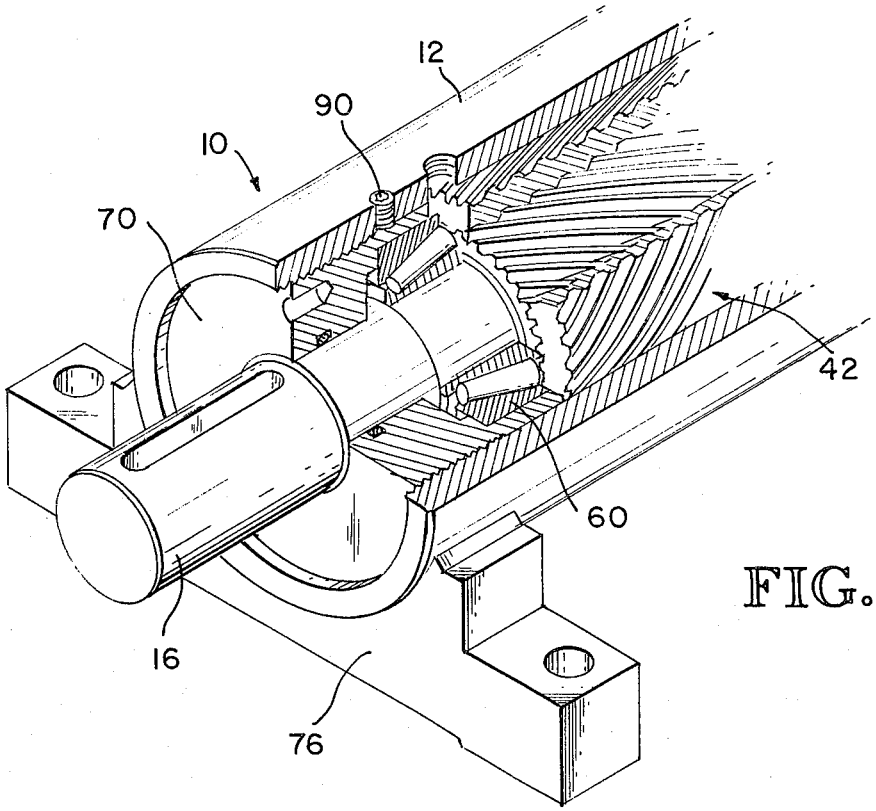
FIG. 5
FIG. 6
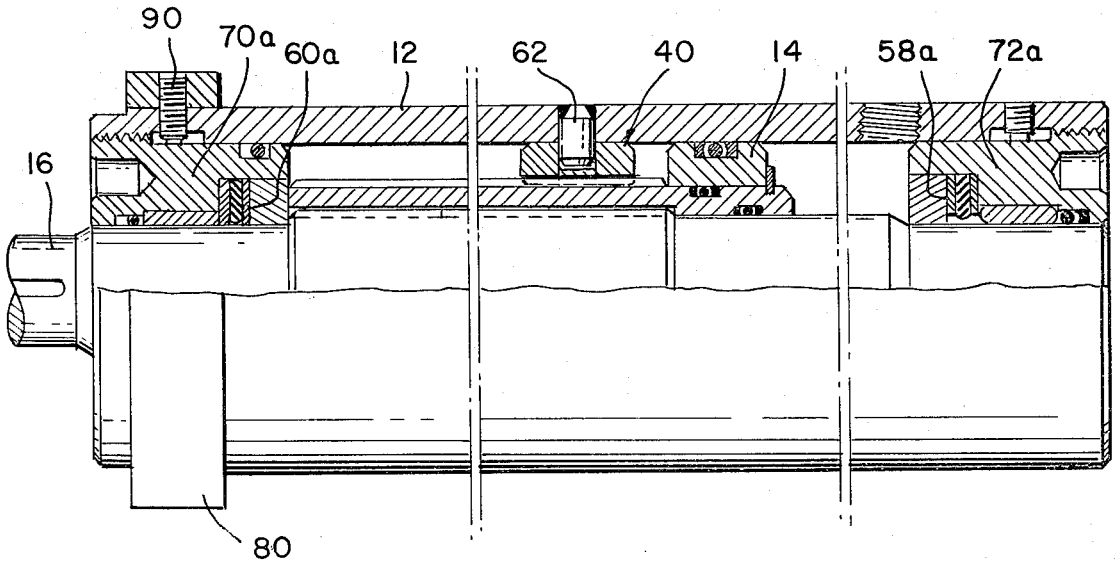

COMBINED LINEAR AND ROTARY ACTUATOR AND FLOATING RING GEAR

BACKGROUND OF THE INVENTION

1. Field of the Invention

This invention pertains to helically splined rotary actuators of the type of either a single helix or double helix. The invention pertains to the combination of such helical rotary actuators with linear actuators for combined linear and rotational movement. The invention also pertains to improvements in the helically splined rotary actuator in that a separately internally mounted ring gear is provided.

2. Description of the Prior Art

Helically splined rotary actuators have heretofore been provided with a ring gear having splines that mesh with a splined piston sleeve for converting linear motion of the piston within the actuator to rotary motion of an output shaft. Either the output shaft is held stationary and the outer housing is rotated or, more commonly, the outer housing is held stationary and the output shaft is rotated. The ring gear in these actuators has heretofore either been integrally formed as a part of the outer cylindrical body, with its splines machined into the integral part of the body, the ring gear has been welded rigid to the outer cylindrical body or the ring gear is held in a flange between two halves of the body.

In the first case of machining the ring gear as a part of the body, considerable machining time and skilled labor are required, making the actuator expensive to manufacture. Secondly, it is generally only possible to machine the splines integrally in the ring gear if the cylinder or cylindrical body is in two sections and the remainder of the outer cylindrical body is later joined as a separate section to the housing. An example of this type of helically splined rotary actuator is found in U.S. Pat. No. 4,373,426 Ser. No. 960,043, filed Nov. 13, 1978.

The other common way of connecting the ring gear is by bolting the ring gear separately to the outer cylindrical housing by a coupling flange which then holds together two separate sections of the outer cylindrical housing. An example of this type of ring gear is shown in U.S. Pat. No. 3,339,463. The mounting flange precludes the use of the actuator as a sliding member within an outer hollow boom or the like. Furthermore, the actuator is difficult to manufacture, requiring several separate parts, has little capability of handling bending moments on the actuator within normal size constraints and is difficult to seal against fluid leakage.

Combined linear and rotary actuators are known. These combined linear and rotary implements have been expensive to manufacture and unwieldy in use. Examples are shown in U.S. Pat. Nos. 4,029,165; 3,933,218; and 3,766,831.

SUMMARY OF THE INVENTION

It is an object of this invention to provide a helically splined rotary actuator in which the ring gear is a separately joined ring gear and the outer cylindrical body of the actuator is a continuous, one-piece body.

It is another object of this invention to provide a helically splined rotary actuator in which a separate ring gear is loosely mounted to the outer cylindrical body so that it may float relative to a splined piston sleeve.

Still a further object of the invention is to provide a helically splined rotary actuator in which the ring gear is joined to a continuous, one-piece, cylindrical body in a flush manner such that the entire body and ring gear joining means can be slid past the seal of a still outer cylindrical tube.

Basically, these objects of this invention are obtained by providing a helically splined rotary actuator having an outer cylindrical tube or cylindrical body, a rotary output shaft, and linear-to-rotary piston transmission means between the outer cylindrical body and the rotary output shaft for providing relative rotary motion between the output shaft and the body. The transmission means includes a splined piston sleeve which meshes with a relatively stationary ring gear which is separate and independent from the outer cylindrical body. In one form of the invention, the outer cylindrical body is a continuous, one-piece body and the ring gear is joined to the body by flush-mounted pins or screws in fastening holes within the body. The one-piece construction of the outer cylindrical body provides rugged high strength while allowing the outer cylindrical body to be slid beyond end seals when forming part of an extendible hollow boom or tube assembly. This feature advantageously allows the rotary actuator to be extended and retracted by a combined linear actuator as well as to enable the outer cylindrical body of the rotary actuator to withstand heaving bending loads, making this an ideal application for an extendable boom manipulating tool. In the preferred embodiment and irrespective of whether the rotary actuator outer cylindrical tube is a single, one-piece body or two separate joined sections to form the body, is a loosely joined ring gear or floating ring gear which, while locked against circumferential or axial movement within the outer cylindrical body, is free to rock slightly to conform to tolerance inaccuracies between the splines of the piston sleeve or splines in the ring gear, or to conform to misalignment of the splines caused by bending of the output shaft or cylindrical body.

A second feature of the invention is a combined linear and rotary actuating device in which a helically splined rotary actuator is provided with an outer cylindrical body which becomes the inner boom for a linear actuating boom and arm assembly. Basically, the assembly is provided with an outer boom tube having end seals and bearings which support an extendable inner cylindrical body. The inner cylindrical body is part of the rotary actuator and is provided with a ring gear that meshes with a linear-to-rotary transmission piston sleeve which converts linear, fluid-powered motion into rotary output of an output shaft. A separate linear actuator is coupled to the cylindrical body of the rotary actuator and to the outer boom tube to extend and retract the rotary actuator cylindrical body relative to the outer boom tube. As is readily apparent, such a device advantageously and compactly provides an articulating implement which can provide rotary motion to a tool coupled to the output shaft while readily extending and retracting that tool into a desired operating position.

Another unique feature of the invention is an adjustable end cap or caps for rotationally positioning the output shaft in the rotary actuator body in extreme rotary positions. This feature advantageously provides for a quick and inexpensive technique for aligning keyways on the output shaft with an adjacent mechanism to be rotated, to set a valve gate position or other applications which require precise limit positions of the output shaft.

BRIEF DESCRIPTION OF THE DRAWINGS

FIG. 5 is a schematic operational view of the embodiment shown in FIG. 4, but with an end cap adjustment illustrating initial rotational positioning of the rotary output shaft.

FIG. 6 is another embodiment of the invention.

DETAILED DESCRIPTION OF THE PREFERRED EMBODIMENTS

Figure 1:
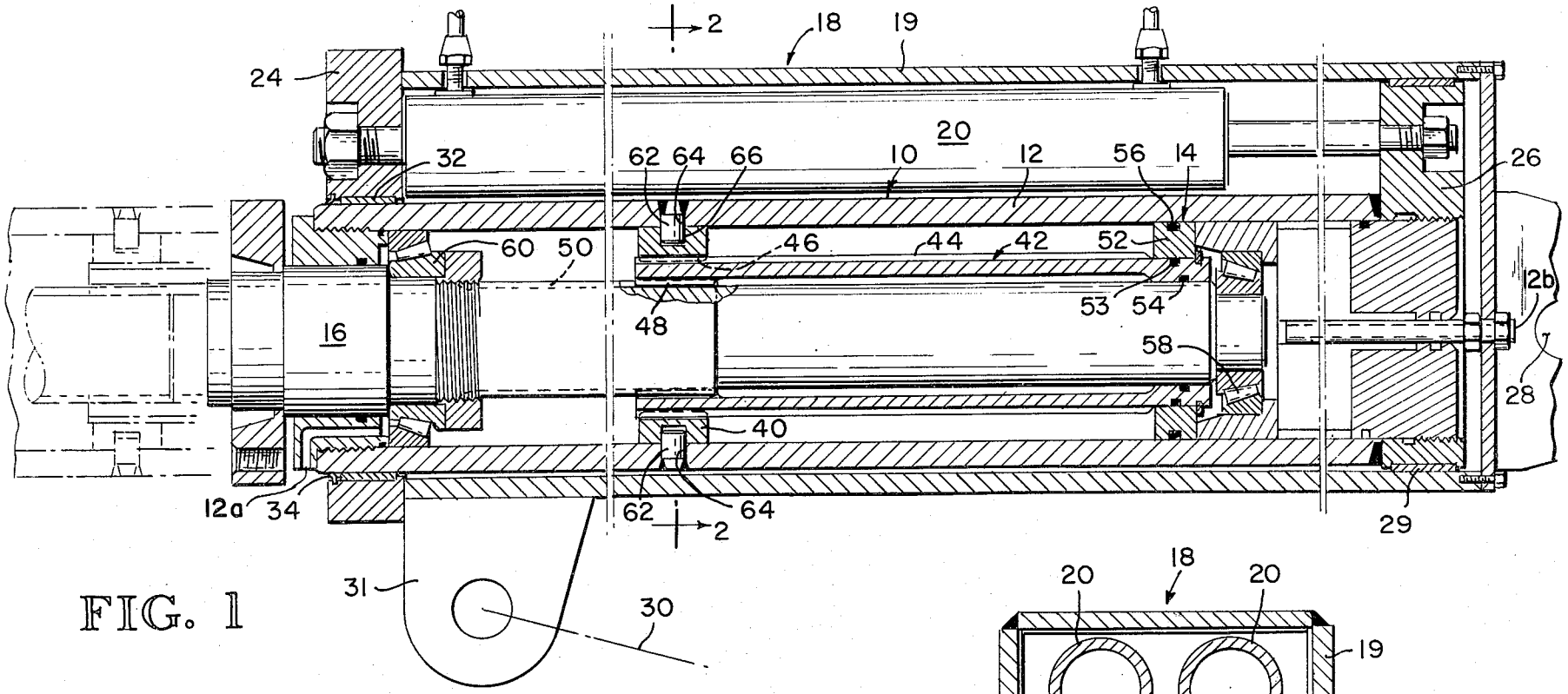
FIG. 1 is an axial section of a combined linear and rotary actuator embodying the principles of the invention.

As best shown in FIG. 1, a helically splined rotary actuator 10 is provided with an outer cylindrical body 12, a linear-to-rotary splined transmission means 14, and a rotary output shaft 16. In this embodiment of the invention, the outer cylindrical body is itself an extendable boom of an outer boom assembly 18 having an outer hollow rectangular boom tube 19. A pair of conventional pneumatic or hydraulic linear piston-cylinder or ram actuators 20 are fixed at one end to an end plate 24 and with their piston rod ends fixed to a sliding carrier 26. As is understood, hydraulic or pneumatic fluid supplied to the linear actuators will extend or retract the helically splined rotary actuator 10 and hydraulic or pneumatic fluid to the rotary actuator 10 will provide rotary motion to the output shaft 16. If desired, articulation about a second axis 28 can be provided by a conventional boom lift cylinder, shown schematically by reference numeral 30 coupled to a clevis 31 mounted on the outer boom 19. This will enable the tool at the end of the rotary output shaft to be swung in a vertical plane or a horizontal plane, depending upon the orientation of the axis 28, axially extended and retracted, or rotated about the central axis of rotation of the rotary actuator 10. These three degrees of articulation in a very compact unit advantageously have numerous applications, such as rock drilling, robot manipulation, etc.

Figure 2:
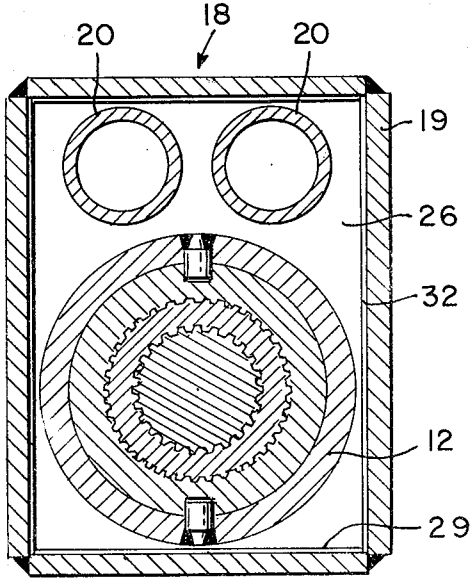
FIG. 2 is a section taken along the line 2—2 of FIG. 1.

As best shown in FIGS. 1 and 2, the carrier 26 is supported on vertical and horizontal bushings 29 and 32, respectively, for supporting the righthand end of the rotary actuator within the outer boom tube 19. The opposite end of the boom tube has a cylindrical bushing 32 and a conventional dirt seal 34 mounted in the end plate 24.

The rotary actuator 10 is provided with a linear-to-rotary transmission means in this embodiment. As is well known, this transmission means includes a ring gear 40 and a piston sleeve 42 having outer helical splines 44 which mesh with helical splines 46 on the ring gear 40. A second internal gear 48 having helical splines is in meshing engagement with splines 50 on the rotary output shaft 16. In the preferred embodiment, a two-piece piston includes a piston ring 52 that is sealed to the sleeve 42 by an O-ring seal 53. A seal 54 seals the piston sleeve against the rotary output shaft and, finally, a seal 56 seals the piston ring 52 against the inner surface of the cylindrical outer housing 12. Conventional radial and thrust bearings 58 and 60 provide support for the rotary output shaft in the cylindrical outer body 12.

It is a unique feature also of this invention that the ring gear 40 is joined to the outer cylindrical housing 12 by pins 62 that are welded in ring gear fastening holes 64 provided in the outer cylindrical housing 12. In this embodiment the pins are welded and machined flush with the outer cylindrical surface of the body 12 so that the entire cylindrical body is a smooth sliding surface for passing the seals and bearings 32 and 34 at the left-hand end of the boom tube 19. Without this smooth flush fastening technique, the rotary helical actuator could not serve as an extendible boom member.

Figure 3:
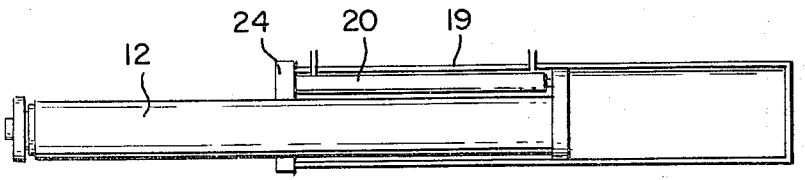
FIG. 3 is a schematic operational view of one embodiment of the invention.

The ring gear 40 can be locked stationary in the position shown in the drawing or preferably is provided with openings 66 which loosely receive the pins 62 to allow the ring gear to float about the pins. This advantageously allows the ring gear to conform to deflections in the splines 44 or to deflections in the outer cylindrical body 12 when the rotary actuator is fully extended as in FIG. 3 and carrying a heavy load which causes a bending moment either in the body or in the output shaft 16.

As is well known in the art of rotary helical actuators, fluid introduced selectively into one of the opposite ends of the cylinder, as, for example, via ports **12*a* or 12*b* in FIG. 1, will cause the piston sleeve 42 to move lengthwise in the cylinder 12. This movement causes the piston sleeve 42 to move past the helical gear 40, causing rotation of the piston sleeve. The internal gear 58 simultaneously causes rotation of the output shaft 16 as the piston sleeve moves lengthwise past the internal gear 48**. There is thus a double rotational output in the output shaft. While this describes the operation of one type of helical actuator, it should be understood, as is well known in the art, that the cylinder can rotate if the output shaft is held stationary and that a single ring gear actuator can provide a single stage of relative rotation between the shaft and the cylinder rather than compound rotation as shown.

Figure 4:
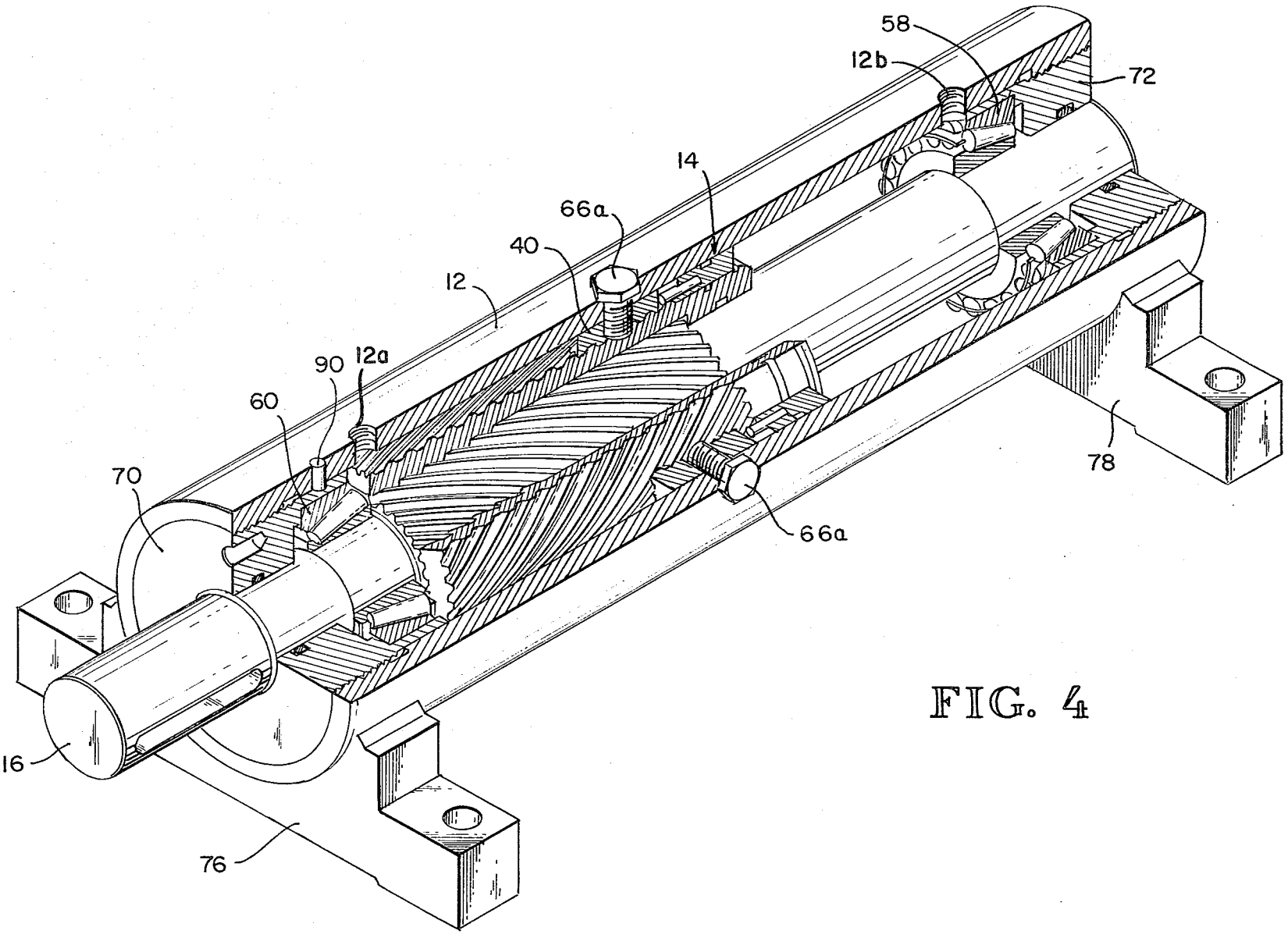
FIG. 4 is an isometric of a second embodiment of the invention with parts broken away for clarity and showing the principles of the invention.

The floating ring gear concept of this invention is also illustrated in FIGS. 4 and 5. FIG. 4 shows a foot-mounted helical rotary actuator having a linear-to-rotary transmission means 14 and an outer cylindrical body 12 and the rotary output shaft 16. This rotary actuator is essentially the same as that shown in FIGS. 1 and 2 but with threaded retaining pins **66*a* rather than welded flush pins as shown in the embodiments of FIGS. 1 and 2. A unique feature of this embodiment is that opposite ends of the cylindrical housing 12 are closed by threaded end caps 70 and 72. Each of these end caps can be axially adjusted as shown by comparison of FIGS. 4 and 5 to initially or finally set the end rotational limits of rotation of the output shaft 16. That is, as the end cap 70 is threaded into the position shown in FIG. 4, it moves the entire radial and thrust bearing 60 to the right. Since the ring gear 40 is stationary on the housing 12, this axial movement of the entire rotary output shaft and linear-to-rotary transmission means 14 will cause rotational movement of the output shaft to a limited number of degrees as shown in FIG. 5. Similarly, the end cap 72 must be screwed to the right or retracted an equal distance to accommodate this movement of the output shaft 16. Set screws 90 (FIG. 5**) then lock the end caps, thus setting the extreme limit of rotation of the output shaft for aligning the shaft with an implement or aligning the implement itself as is well understood.

It should also be understood that while a through output shaft held with bearings at both ends is illustrated, the principles of the invention both for the ring gear concept and continuous outer cylinderical outer tube concept are also applicable to initial positioning of stub shaft helically splined rotary actuators. An actuator is shown in FIG. 4 as illustrated for an application in which the outer cylindrical housing 12 is secured to foot brackets 76, 78 which can be bolted to a stationary frame or the like.

In the embodiment shown in FIG. 6 a similar helically splined rotary actuator is provided with an outer cylindrical one-piece continuous tube 12, a linear-to-rotary transmission splined piston sleeve means 14, a rotary output shaft 16 which is supported at opposite ends by axial and radial bearings 60*a* and 58*a*. End caps 70*a* and 72*a* are provided to mount the bearings and are positionable axially for initially adjustments of the rotary position of the output shaft 16. In this embodiment a rectangular end flange 80 is secured to the outer cylindrical housing 12 for end-mounting the rotary actuator on a stationary frame or the like.

While the preferred embodiments of the invention have been illustrated and described, it should be understood that variations will be apparent to one skilled in the art without departing from the principles herein. According, the invention is not to be limited to the specific embodiments shown in the drawing.

I claim:

1. A fluid-powered, helically splined rotary actuator comprising an outer cylindrical body, an output shaft, and linear-to-rotary transmission means between the body and the output shaft for providing relative rotational movement in opposite directions between the body and the output shaft, said transmission means including an encircling, one-piece, circular, splined ring gear separate from and independently joined to said body, said body including an elongated, one-piece continuous cylinder having a sidewall and having ring gear fastening openings within the sidewall, ports in said body for introducing pressuriTd fluid into the cylinder, means in said fastening openings for joining the ring gear to said sidewall and sealing the fastening openings against leakage of pressurized fluid out of said cylinder, and wherein said joining means transmits torque between the ring gear and the cylinder and axially locates the ring gear within the cylinder, said body having a smooth outer surface, said ring gear joining means including fasteners mounted flush with said body outer surface, an outer tube encircling said body, said outer tube having at least one set of end seals, and wherein said outer cylindrical body and flush ring gear fasteners provide a continuous smooth surface movable past said end seals without interference therewith.

2. The actuator of claim 1, said transmission means also including a splined piston sleeve, said joining means including fasteners loosely coupling said cylinder and said ring gear, wherein said ring gear floats within said cylinder while being precluded against substantial axial or circumferential movement to provide alignment between the ring gear and said splined piston sleeve to accommodate manufacturing tolerance inaccuracies and bending loads on the actuator.

3. The actuator of claim 1, said fasteners being pins welded into said fastening openings of said cylinder, said welds sealing the fastening openings around the pins.

4. The actuator of claim 1, including an extendible linear actuator within said outer tube and coupled to the tube and the rotary actuator cylindrical body, and means for extending said linear actuator for moving said cylindrical body into and out of said tube, whereby both linear and rotatable movements are provided between the output shaft and said outer tube.

5. A combined linear and rotary actuator device comprising an outer boom tube, a cylindrical inner boom tube slidably mounted in said outer boom tube, linear actuating means for extending and retracting said inner tube within said outer boom tube, a helically splined rotary actuator having an output shaft and helically splined linear-to-rotary transmission means between said inner tube and said output shaft, and means for delivering fluid to said actuator for providing relative linear and rotational movement between said output shaft and said outer boom tube, including end seals at an outer end of said outer boom tube between said outer boom tube and said inner tube, said inner tube being a one-piece integral tube with a smooth outer surface, said linear-to-rotary transmission means including a splined ring gear and a splined piston sleeve, and means fastening said splined ring gear to said inner tube, said fastening means terminating flush with said inner tube outer surface wherein said inner tube is slidable past said end seals without interfering with said end seals.

6. The combined actuator of claim 5, said linear actuating means including a set of piston cylinders, each having a rod connected to a carriage, bearing means between said carriage and said outer boom tube for slidably supporting said carriage in said boom tube, and means coupling the carriage to said inner tube for moving said inner tube.

7. The combined actuator of claim 5, said ring gear fastening means loosely coupling the ring gear to the inner tube for allowing limited movement of the ring gear.

* * * * *